US007174868B2

(12) United States Patent
Yoshijima et al.

(10) Patent No.: US 7,174,868 B2
(45) **Date of Patent: *Feb. 13, 2007**

(54) RESIN CYLINDER HEAD COVER

(75) Inventors: Kazuya Yoshijima, Okazaki (JP); Hidemi Kato, Aichi (JP); Akihiro Osaki, Okazaki (JP); Naohiro Hasegawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/171,461

(22) Filed: Jul. 1, 2005

(65) Prior Publication Data

US 2006/0000434 A1 Jan. 5, 2006

(30) Foreign Application Priority Data

Jul. 5, 2004 (JP) ..... 2004-198357

(51) Int. Cl.
*F01M 9/10* (2006.01)

(52) U.S. Cl. ..... 123/90.38; 123/90.33; 123/90.12; 123/193.5; 123/195 C; 29/888.01; 29/888.061

(58) Field of Classification Search ..... 123/90.38
See application file for complete search history.

(56) References Cited

U.S. PATENT DOCUMENTS 6,076,492 A * 6/2000 Takahashi ..... 123/90.17
6,289,861 B1 * 9/2001 Suzuki ..... 123/90.17
6,340,322 B1 1/2002 Yoshida et al.
6,684,836 B2 * 2/2004 Inoue ..... 123/90.17
6,776,131 B2 8/2004 Dietz
6,832,587 B2 * 12/2004 Wampula et al. ..... 123/90.38
6,912,982 B2 * 7/2005 Lehmann et al. ..... 123/90.15
2006/0011158 A1 * 1/2006 Yoshijima et al. ..... 123/90.12

FOREIGN PATENT DOCUMENTS

DE 102 23 431 A1 12/2003
DE 601 04 572 T2 8/2005
JP A-11-210425 8/1999
JP B2-3171009 3/2001
JP A-2003-227321 8/2003
JP B2-3525709 2/2004
JP A-2004-232615 8/2004

* cited by examiner

*Primary Examiner*—Thomas Denion
*Assistant Examiner*—Kyle M. Riddle
(74) *Attorney, Agent, or Firm*—Oliff & Berridge, PLC

(57) ABSTRACT

A resin cylinder head cover includes an attaching portion and a sleeve. The attaching portion is formed of resin, and is a portion of the cylinder head cover to which the oil control valve is to be attached. The sleeve is embedded in the attaching portion. The sleeve has an interior space that permits the oil control valve to be accommodated therein and oil holes. Each oil hole is selectively connected to one of ports of the oil control valve accommodated in the interior space of the sleeve. The sleeve is formed of material having higher rigidity than the resin forming the attaching portion. Therefore, the cylinder head cover maintains highly reliable attachment of an oil control valve without a large number of high precision machining steps and prevents deformation of the attaching portion.

9 Claims, 8 Drawing Sheets

RESIN CYLINDER HEAD COVER

BACKGROUND OF THE INVENTION

The present invention relates to a resin cylinder head cover to which an oil control valve (OCV) is attached that controls supply and drainage of hydraulic pressure to and from a variable valve actuation mechanism of an internal combustion engine.

In a case where a hydraulically operated variable valve actuation mechanism is provided for a timing sprocket and a timing pulley of an internal combustion engine, hydraulic pressure supplying/draining oil passages from the oil control valve to the variable valve actuation mechanism are formed in a camshaft.

As described above, since hydraulic pressure needs to be supplied to one of the oil passages formed in the camshaft, a configuration has been proposed in which an oil control valve is attached to the inner surface of the cylinder head cover, and the hydraulic pressure is supplied to the oil passage in the camshaft from the oil control valve via an oil passage formed in a cam cap.

However, according to the configuration in which the oil control valve is accommodated inside the cylinder head cover as described above, the height of the cylinder head cover is increased by a space necessary for accommodating the oil control valve. This undesirably increases the size of the internal combustion engine. Therefore, a technique has been proposed in which an oil control valve is accommodated in a valve case attached to the cylinder head cover to cover an opening formed in the upper wall of the cylinder head cover (for example, see Japanese Patent No. 3525709).

With this configuration, since the distance between the oil control valve and the cam cap is increased, an intermediate member, which has oil passages for connecting the oil passages in the oil control valve to the oil passages in the cam cap, is additionally arranged between the oil control valve and the cam cap. In this case, the hydraulic pressure supplying/draining oil passages extending from the oil control valve to the variable valve actuation mechanism is formed by the valve case, the intermediate member, the cam cap, and the camshaft.

However, according to the configuration of Japanese Patent No. 3525709, a large number of components are employed. Moreover, since metal machining needs to be performed, the valve case and the intermediate member need to be machined with high precision as well as the oil control valve. In particular, since the attachment between the valve case and the intermediate member and between the valve case and the oil control valve must be oil-tight, the valve case needs to be machined with high precision at least at two attaching portions. Furthermore, since the single valve case is machined at two attaching portions, the machining process on each attaching portion may cause the other attaching portion to be deformed due to cutting resistance. Therefore, the attaching accuracy of the oil control valve including the intermediate member may be decreased. Moreover, since high precision metal processing is executed many times within a narrow range, foreign object such as chips is likely to remain on the valve case.

If the cylinder head cover and the valve case configured as described above are formed with resin to achieve the weight reduction, foreign object such as chips will not remain. However, when attaching the cylinder head cover to a cylinder head, the cylinder head cover may be deformed since the rigidity of resin is relatively low. This may, in turn, affect the valve case. In this case, although the two attaching portions are machined with high precision, the dimensional accuracy of the attaching portions may be decreased and the oil control valve may not be properly attached to the valve case due to the deformation caused when attaching the cylinder head cover to the cylinder head.

SUMMARY OF THE INVENTION

Accordingly, the objective of the present invention is to provide a resin cylinder head cover that maintains highly reliable attachment of an oil control valve without a large number of high precision machining steps and prevents deformation of the attaching portion.

To achieve the foregoing and other objectives and in accordance with the purpose of the present invention, a resin cylinder head cover that permits an oil control valve to be attached is provided. The oil control valve has ports and controls supply and drainage of hydraulic pressure to and from a variable valve actuation mechanism of an internal combustion engine. The cylinder head cover includes an attaching portion and a sleeve. The attaching portion is formed of resin, and is a portion of the cylinder head cover to which the oil control valve is to be attached. The sleeve is embedded in the attaching portion. The sleeve has an interior space that permits the oil control valve to be accommodated therein and oil holes. Each oil hole is selectively connected to one of the ports of the oil control valve accommodated in the interior space of the sleeve. The sleeve is formed of material having higher rigidity than the resin forming the attaching portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
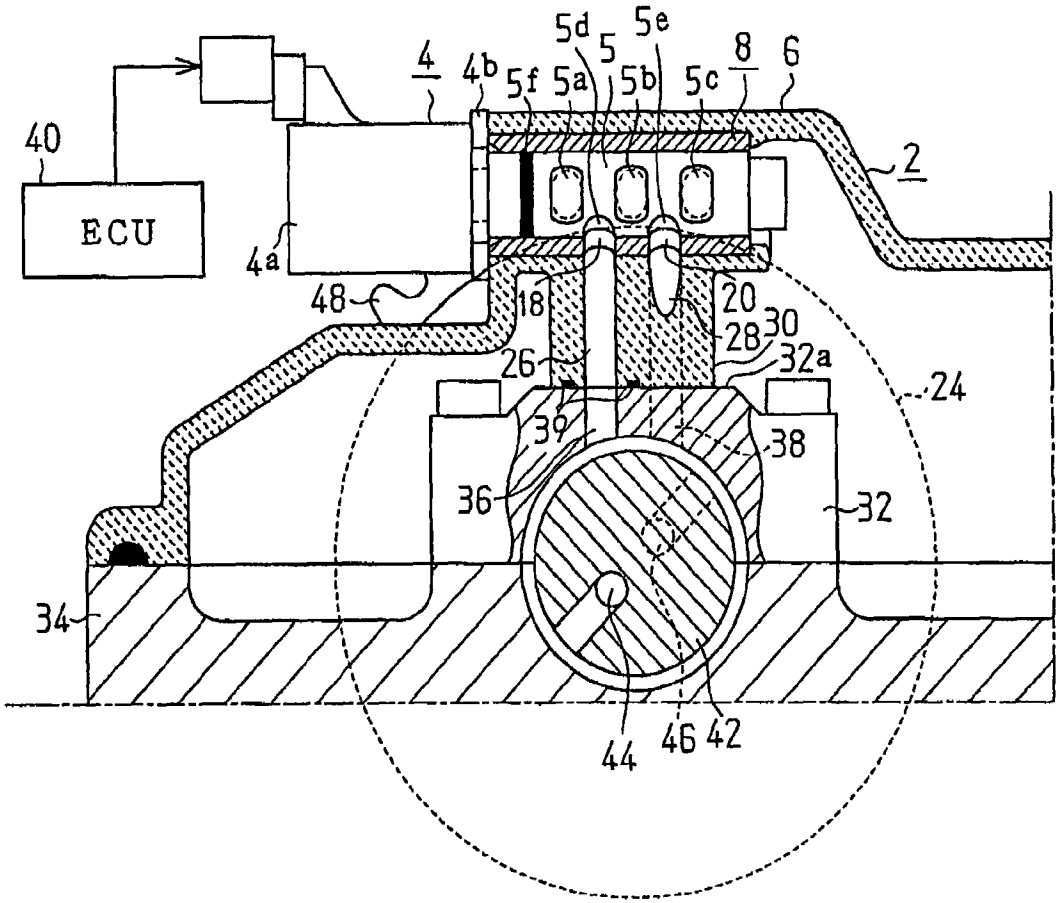
FIG. 1 is a longitudinal cross-sectional view illustrating the vicinity of an attaching portion of a cylinder head cover according to a first embodiment of the present invention to which an OCV is attached.
Figure 2:
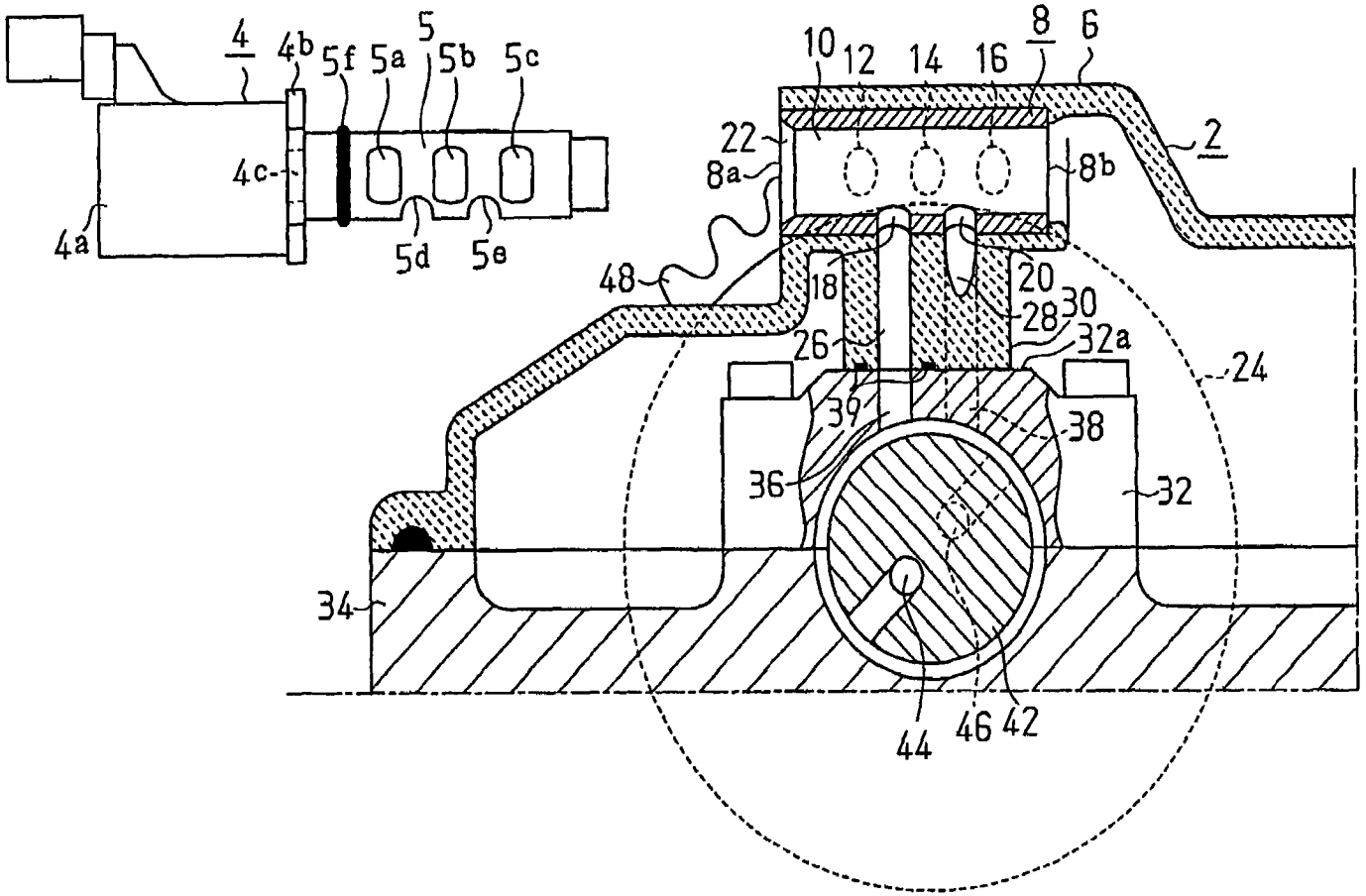
FIG. 2 is a longitudinal cross-sectional view illustrating, together with the OCV, the vicinity of the attaching portion of the cylinder head cover of FIG. 1 before the OCV is attached.
Figure 3:
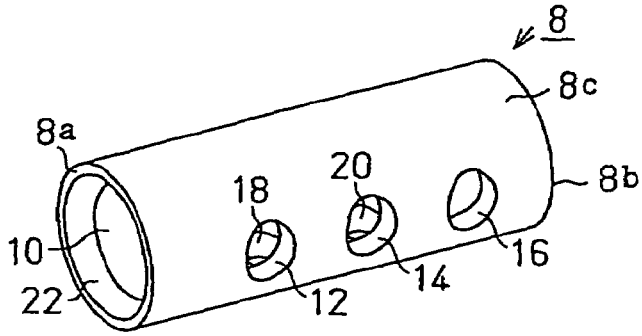
FIG. 3(A) is a perspective view illustrating a sleeve of the cylinder head cover of FIG. 1.
FIG. 3(B) is a front view illustrating the sleeve of FIG. 3(A)
FIG. 3(C) is a left side view illustrating the sleeve of FIG. 3(A)
FIG. 3(D) is a right side view illustrating the sleeve of FIG. 3(A)
FIG. 3(E) is a rear view illustrating the sleeve of FIG. 3(A)
Figure 3:
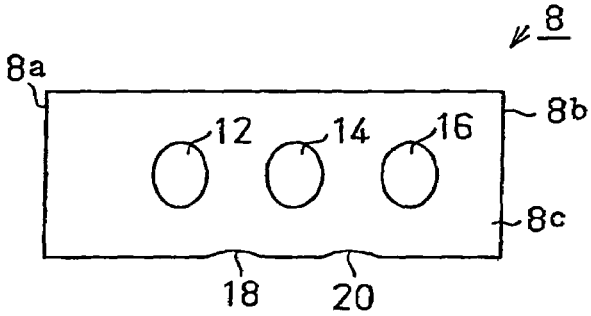
Figure 3:
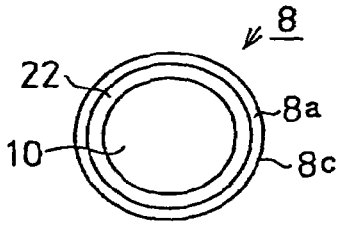
Figure 3:
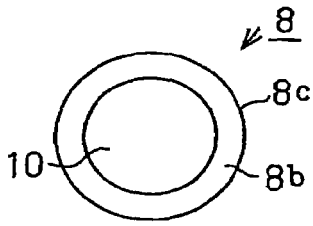
Figure 3:
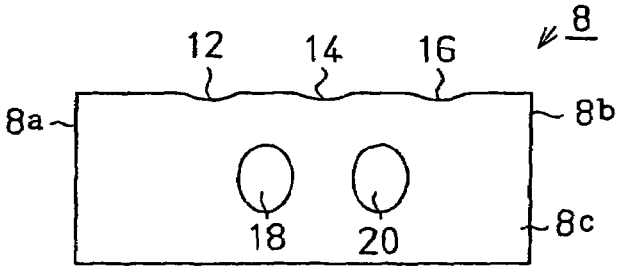

A first embodiment of the present invention will now be described with reference to FIGS. 1 to 3(E). FIG. 1 shows a part of an engine to which a cylinder head cover 2 according to the first embodiment is applied. More specifically, FIG. 1 shows the vicinity of an attaching portion 6 of a cylinder head cover 2. The attaching portion 6 is a portion of the cylinder head cover 2 to which an OCV 4 is attached. FIG. 2 shows, together with the OCV 4, the vicinity of the attaching portion 6 of the cylinder head cover 2 before the OCV 4 is attached.

The cylinder head cover 2 is integrally molded with resin. When integrally molding the cylinder head cover 2, a sleeve 8 is arranged in a mold to be covered with resin through insert molding. The sleeve 8 is thus integrated with the cylinder head cover 2. In the integrated state, an OCV insertion end 8*a* of the sleeve 8 is open to the outside of the cylinder head cover 2, and an opposite end 8*b* of the sleeve 8 is open to the inside of the cylinder head cover 2.

The sleeve 8 is cylindrical as shown in FIGS. 3(A) to 3(E) and is formed of material having the same coefficient of thermal expansion as a spool housing 5, which is a main body of the OCV 4, shown in FIGS. 1 and 2. More specifically, the sleeve 8 is formed of aluminum base alloy. The sleeve 8 may also be formed of metal material that is exactly the same as the spool housing 5 of the OCV 4.

The sleeve 8 includes oil holes 12, 14, 16, 18, 20, which are formed at positions corresponding to five ports 5*a*, 5*b*, 5*c*, 5*d*, 5*e* formed on the spool housing 5 of the OCV 4. The oil holes 12, 14, 16, 18, 20 communicate with an interior space of the sleeve 8, which is a mounting bore 10. A tapered surface 22 is formed at the OCV insertion end 8*a* of the sleeve 8 to facilitate attachment of the OCV 4. In FIGS. 1 and 2, the oil holes 12, 14, 16 are shown by a broken line on the sleeve 8 since the oil holes 12, 14, 16 are located in a part that has been cut away.

Primer is applied to an outer circumferential surface 8*c* of the sleeve 8 before insert molding. Thus, the sleeve 8 is strongly bonded with resin due to the primer in the cylinder head cover 2 in which the sleeve 8 is insert molded. During insert molding, slide pins are arranged in the mold to be continuous with the oil holes 12 to 20 formed in the sleeve 8. In this manner, oil passages that are connected to the oil holes 12 to 20 are also formed in the cylinder head cover 2. Among the oil passages of the cylinder head cover 2, intermediate oil passages 26, 28 are connected to a variable valve actuation mechanism, which is a variable valve timing mechanism 24 in the first embodiment. The intermediate oil passages 26, 28 are formed in a contact portion 30 of the cylinder head cover 2.

The contact portion 30 is integrally molded with resin to the attaching portion 6 at the lower surface of the cylinder head cover 2 to connect the attaching portion 6 to a cam cap 32. When the cylinder head cover 2 is fastened to a cylinder head 34 with a bolt, the lower end of the contact portion 30 abuts against a top surface 32*a* of the cam cap 32 and the intermediate oil passages 26, 28 are connected to cam cap oil passages 36, 38 formed in the cam cap 32. At the joint between the contact portion 30 and the cam cap 32, a substantially figure-eight shaped O-ring 39 is arranged about the intermediate oil passages 26, 28 and the cam cap oil passages 36, 38 acting as an oil seal.

The spool housing 5 of the OCV 4 is inserted in the cylinder head cover 2 configured as described above from the OCV insertion end 8*a* of the sleeve 8 as shown in FIG. 2 so that the spool housing 5 is accommodated in the mounting bore 10 of the sleeve 8. The mounting bore 10 of the sleeve 8 is formed with high precision such that a certain clearance is formed between the spool housing 5 and the sleeve 8. Since the sleeve 8 is formed of metal material that has rigidity sufficiently higher than resin that forms the cylinder head cover 2, the dimensional accuracy of the mounting bore 10 is sufficiently maintained even if the resin is distorted after insert molding, the resin is deformed when the cylinder head cover 2 is fastened to the cylinder head 34, or thermal deformation is caused subsequently. Therefore, the spool housing 5 is easily inserted to a predetermined position in the mounting bore 10, and the OCV 4 is attached to the attaching portion 6 in a suitable manner as shown in FIG. 1. An O-ring 5*f* is arranged at the proximal portion of the spool housing 5 to prevent hydraulic oil that slightly leaks from the clearance between the spool housing 5 and the sleeve 8 from being drained to the outside of the cylinder head cover 2. In addition, a bracket 4*b* is located on the OCV 4. The bracket 4*b* has a bolt hole 4*c* in which a bolt is inserted. The bolt is then fastened to a threaded bore located near the attaching portion 6 to prevent the OCV 4 from falling off and rotating.

The OCV 4 is mounted as described above and an ECU (electronic control unit) 40 controls exciting current to a solenoid section 4*a* of the OCV 4 in accordance with the operating state of the engine. Accordingly, the hydraulic pressure supplied to the port 5*b* of the spool housing 5 is supplied to one of the oil holes 18, 20 and drained from the other one of the oil holes 18, 20. In this manner, the hydraulic pressure is supplied to and drained from the variable valve timing mechanism 24 using the intermediate oil passages 26, 28, the cam cap oil passages 36, 38, and two oil passages 44, 46 located in a camshaft 42. For example, when the hydraulic pressure is supplied to the variable valve timing mechanism 24 through one of the channels, that is, through the intermediate oil passage 26, the cam cap oil passage 36, and the oil passage 44, and the hydraulic pressure is drained via the other channel, that is, the intermediate oil passage 28, the cam cap oil passage 38, and the oil passage 46, the variable valve timing mechanism 24 is retarded. Thus, the rotational phase of the camshaft 42 with respect to a timing sprocket 48 is retarded, thereby retarding the valve timing.

Contrastingly, when the hydraulic pressure is supplied to the variable valve timing mechanism 24 through the intermediate oil passage 28, the cam cap oil passage 38, and the oil passage 46, and is drained through the intermediate oil passage 26, the cam cap oil passage 36, and the oil passage 44, the variable valve timing mechanism 24 is advanced. Thus, the rotational phase of the camshaft 42 with respect to the timing sprocket 48 is advanced, thereby advancing the valve timing.

The cam cap 32 against which the contact portion 30 abuts is one of cam caps for the camshaft 42 that is arranged closest to the variable valve timing mechanism 24. Therefore, the oil passages 44, 46 in the camshaft 42 are the shortest compared to cases where the contact portion 30 abuts against another one of the cam caps. The position where the sleeve 8 is inserted, that is, the portion of the cylinder head cover 2 where the sleeve 8 is embedded, is substantially directly above the cam cap 32. Therefore, the longitudinal length of the contact portion 30 is the shortest, and the intermediate oil passages 26, 28 in the contact portion 30 are also the shortest.

The first embodiment has the following advantages.

(a) According to the cylinder head cover 2 of the first embodiment, a portion that requires high machining precision is the mounting bore 10 of the sleeve 8 in which the OCV 4 is accommodated. Other portions do not require the high machining precision as that required in machining of the mounting bore 10. Therefore, high precision machining is performed only a few times and the load during machining is reduced. Furthermore, the influence among a number of machining portions is eliminated, and the influence of the cutting resistance on the dimensional accuracy of the mounting bore 10 is eliminated.

The resin cylinder head cover 2 may be deformed when the cylinder head cover 2 is fastened to the cylinder head 34, or the cylinder head cover 2 may be deformed due to creep. However, the sleeve 8 formed of metal that has higher rigidity than the resin, or more specifically, the sleeve 8 formed of aluminum base alloy maintains the dimensional accuracy of the mounting bore 10 against the deformation.

Therefore, the cylinder head cover 2 maintains the highly reliable attachment of the OCV 4 without execution of a number of high precision machining steps and prevents deformation of the attaching portion 6.

(b) The cylinder head cover 2 includes the contact portion 30, which is integrally formed with the attaching portion 6. The intermediate oil passages 26, 28 formed in the contact portion 30 connect the oil holes 18, 20 to the cam cap oil passages 36, 38. As a result, the ECU 40 can control supply and drainage of the hydraulic pressure to and from the variable valve timing mechanism 24 using the OCV 4.

As described above, since the cylinder head cover 2 directly contacts the cam cap 32 via the contact portion 30, the OCV 4 is connected to the variable valve timing mechanism 24 with the oil passages. Thus, components such as the intermediate members of Japanese Patent No. 3525709 are unnecessary. As a result, the manufacturing cost is decreased without increasing the number of components unnecessarily.

(c) As described above, the cam cap 32 to which the hydraulic pressure is supplied is one of the cam caps that is located closest to the variable valve timing mechanism 24. Furthermore, the sleeve 8 is embedded at a portion of the cylinder head cover 2 substantially directly above the cam cap 32. Therefore the OCV 4 controls supply and drainage of the hydraulic pressure to and from the variable valve timing mechanism 24 using very short oil passages. This further increases the speed of the pressure response and improves the control response of the variable valve timing mechanism 24 controlled by the ECU 40.

(d) Furthermore, the sleeve 8 that is formed of material having higher rigidity than resin is embedded in the cylinder head cover 2 in the vicinity of the variable valve timing mechanism 24. Therefore, the rigidity is increased at a portion of the cylinder head cover 2 in the vicinity of the variable valve timing mechanism 24, and vibration noise is thus suppressed. In particular, the variable valve timing mechanism 24 is a section where the timing sprocket 48 is provided to which the drive force of the engine is transmitted via a timing chain. Therefore, the vibration noise is effectively suppressed.

(e) Since the sleeve 8 and the OCV 4 (the spool housing 5) have substantially the same coefficient of thermal expansion, variation of the clearance between the sleeve 8 and the spool housing 5 due to thermal influence is prevented. Therefore, the highly reliable attachment of the OCV 4 is maintained. Furthermore, since the clearance is not thermally influenced when in use after attaching the OCV 4, the OCV 4 controls the hydraulic pressure in a stable manner.

(f) The sleeve 8 is embedded in and secured to the cylinder head cover 2 through insert molding. Primer is applied to the outer circumferential surface 8*c* of the sleeve 8 formed of metal before insert molding. In this manner, the sleeve 8 is embedded in the cylinder head cover 2 and securely bonded with the cylinder head cover 2. Thus, the sleeve 8 is stably secured to the cylinder head cover 2 although the sleeve 8 is formed of material different from the cylinder head cover 2.

Figure 4:
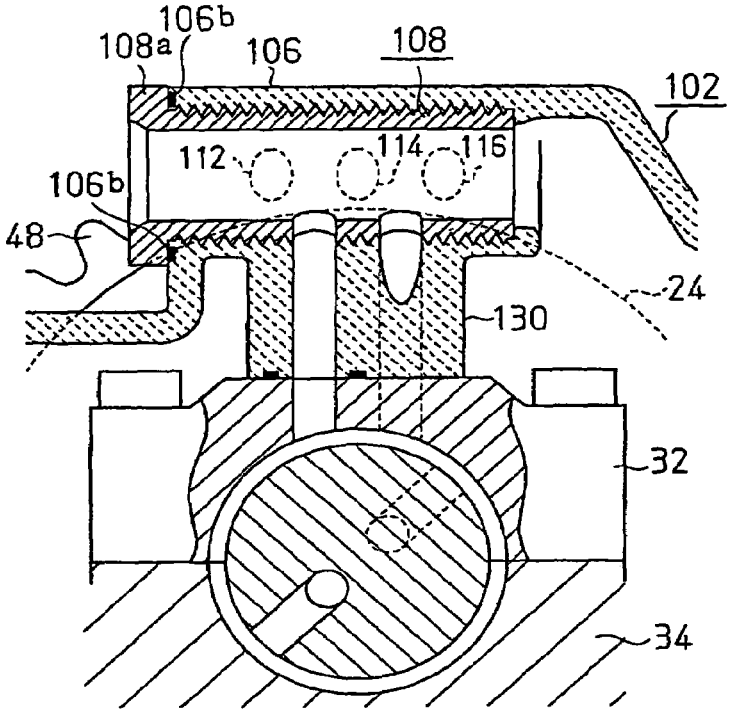
FIG. 4 is a longitudinal cross-sectional view illustrating the vicinity of an attaching portion of a cylinder head cover according to a second embodiment, in which a sleeve is screwed to the attaching portion.
Figure 5:
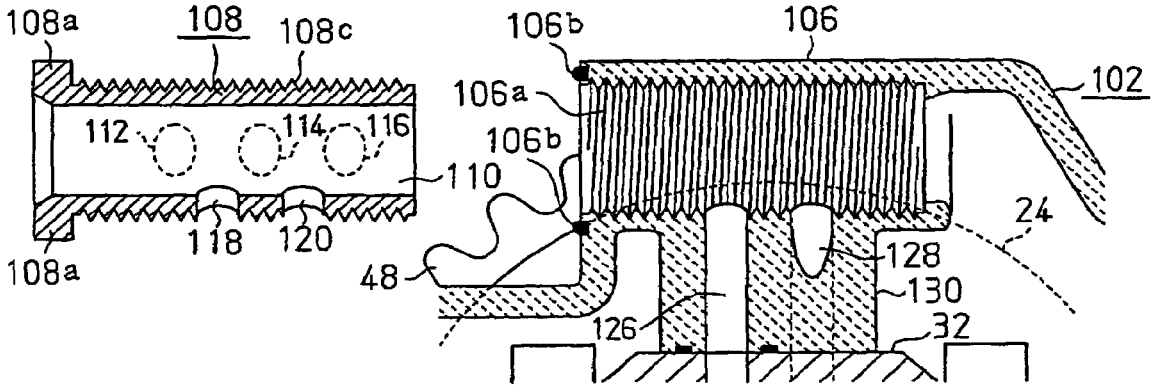
FIG. 5 is a longitudinal cross-sectional view illustrating, together with the sleeve, the vicinity of the attaching portion of the cylinder head cover of FIG. 4 before the sleeve is attached to the attaching portion.

A second embodiment of the present invention will now be described with reference to FIGS. 4 and 5. FIGS. 4 and 5 show the vicinity of an attaching portion 106 of a cylinder head cover 102 according to the second embodiment in which a sleeve 108 is screwed to the attaching portion 106. The cylinder head cover 102 of the second embodiment has the same configuration as the cylinder head cover 2 of the first embodiment except the attachment structure of the sleeve 108 and an attaching portion 106.

In the second embodiment, an internal threaded portion 106*a* is formed on the inner circumferential surface of the attaching portion 106 as shown in FIG. 5 during integral molding of the cylinder head cover 102 or by thread cutting after the integral molding. The sleeve 108 has an external threaded portion 108*c* formed on the outer circumferential surface of the sleeve 108 and is screwed to the internal threaded portion 106*a*. At this time, the screw-in amount and the rotational phase are adjusted such that three oil passages formed in the cylinder head cover 102 and intermediate oil passages 126, 128 formed in a contact portion 130 are aligned with oil holes 112, 114, 116, 118, 120 of the sleeve 108. In FIGS. 4 and 5, the oil holes 112, 114, 116 are shown by a broken line on the sleeve 108 since the oil holes 112, 114, 116 are located in a part that has been cut away.

When the sleeve 108 is screwed into the attaching portion 106, an O-ring 106*b* located at the rim of the opening end of the attaching portion 106 abuts against a flange 108*a* of the sleeve 108. Consequently, the joint portion between the external threaded portion 108*c* and the internal threaded portion 106*a* is sealed. To facilitate understanding, only the cut surfaces of the O-ring 106*b* is shown in FIG. 5.

The sleeve 108 may be secured to the attaching portion 106 only by screwing, but the sleeve 108 may be screwed to the attaching portion 106 after applying sealing material or an adhesive to the external threaded portion 108*c* or the internal threaded portion 106*a*. In this case, the O-ring 106*b* does not need to be used.

In this manner, the cylinder head cover 102 in which the sleeve 108 is integrated is attached to the cylinder head 34. Thereafter, an OCV is attached to a mounting bore 110 in the sleeve 108, and a bracket of the OCV is fastened to the cylinder head cover 102.

The second embodiment has the following advantage.

(a) Since the cylinder head cover 102 and the sleeve 108 are integrated by screwing them together, although the sleeve 108 is formed of material different from the cylinder head cover 2, the cylinder head cover 102 and the sleeve 108 are secured in a stable manner.

With this configuration also, the advantages (a) to (e) of the first embodiment are provided.

Figure 6:
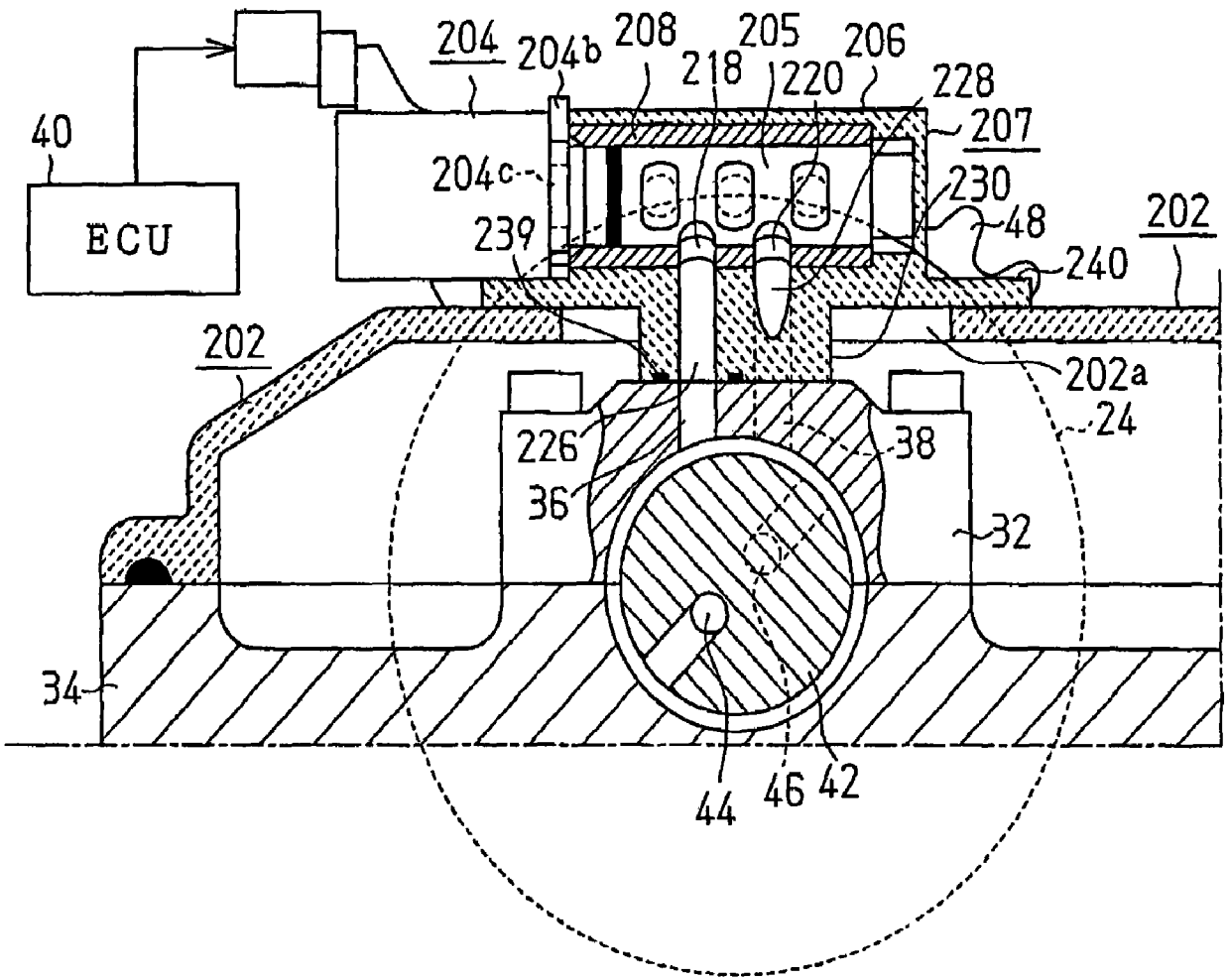
FIG. 6 is a longitudinal cross-sectional view illustrating the vicinity of an attaching portion of a cylinder head cover according to a third embodiment of the present invention to which an OCV is attached.
Figure 7:
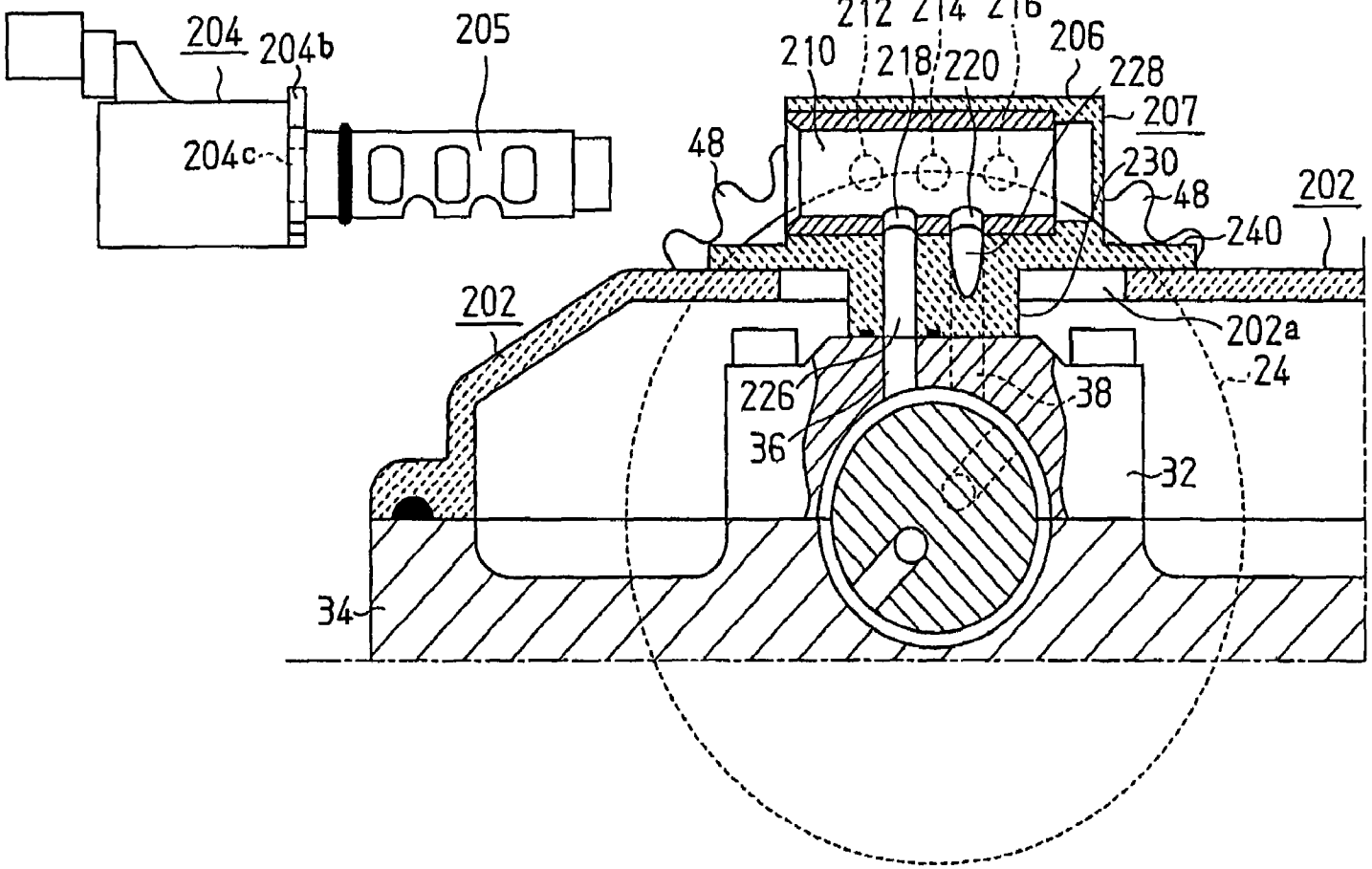
FIG. 7 is a longitudinal cross-sectional, view illustrating, together with the OCV, the vicinity of the attaching portion of the cylinder head cover of FIG. 6 before the OCV is attached.
Figure 8:
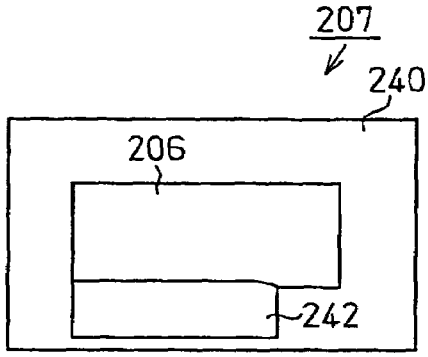
FIG. 8(A) is a plan view illustrating a valve case of the cylinder head cover of FIG. 6.
FIG. 8(B) is a front view illustrating the valve case of FIG. 8(A)
FIG. 8(C) is a bottom view illustrating the valve case of FIG. 8(A)
FIG. 8(D) is a perspective view illustrating the valve case of FIG. 8(A)
FIG. 8(E) is a left side view illustrating the valve case of FIG. 8(A)
FIG. 8(F) is a right side view illustrating the valve case of FIG. 8(A)
Figure 8:
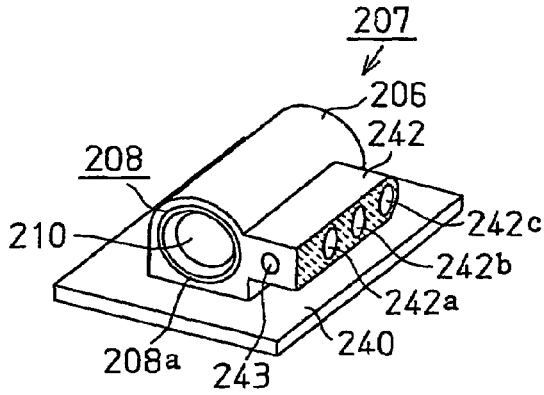
Figure 8:
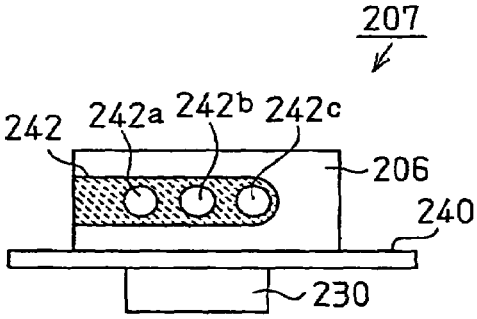
Figure 8:
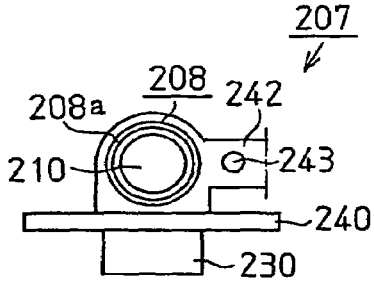
Figure 8:
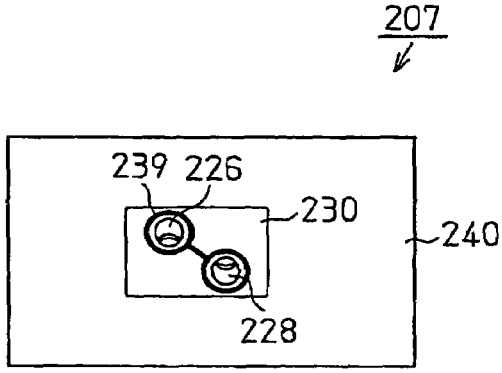
Figure 8:
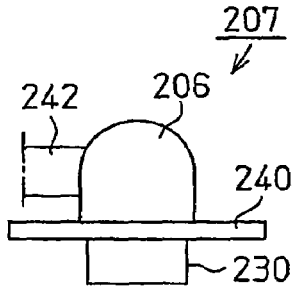

A third embodiment of the present invention will now be described with reference to FIGS. 6 to 8(F). FIG. 6 shows the vicinity of an attaching portion 206 of a cylinder head cover 202 according to a third embodiment to which an OCV 204 is attached. FIG. 7 shows, together with the OCV 204, the vicinity of the attaching portion 206 of the cylinder head cover 202 before the OCV 204 is attached. In the third embodiment, the attaching portion 206 is not integrally formed with the cylinder head cover 202, but is formed on a resin valve case 207 (which corresponds to a resin component) that is molded in advance separately from the cylinder head cover 202. In other words, the cylinder head cover 202 includes the valve case 207, which serves as the attaching portion 206, and a cover main body, which is a portion of the cylinder head cover 202 other than the valve case 207. The valve case 207 is formed separately from the cover main body and is attached to the cover main body.

The valve case 207 is integrally molded with resin into a shape as shown in FIGS. 8(A) to 8(F). The metal sleeve 208 that has the same shape as the sleeve 8 of the first embodiment is secured to the valve case 207 through insert molding. The valve case 207 has a plate-like flange portion 240. The attaching portion 206 formed into a substantially cylindrical shape with resin is located on the upper surface of the flange portion 240. The sleeve 208 is embedded in and secured to the resin that forms the attaching portion 206 with an OCV insertion end 208*a* open to the outside.

A hydraulic oil supplying/draining section 242 is formed on the outer circumferential portion of the attaching portion 206. Three oil passages 242*a*, 242*b*, 242*c* are formed through the hydraulic oil supplying/draining section 242. The oil passages 242*a*, 242*b*, 242*c* are connected to three oil holes 212, 214, 216 of the sleeve 208 located inside the attaching portion 206. The distal end of the hydraulic oil supplying/draining section 242 further extends to supply and drain the hydraulic oil to and from the oil passages formed in the cylinder head cover 202. A bolt screw-in hole 243 is formed in the hydraulic oil supplying/draining section 242 on the end near the OCV insertion end 208*a*. As shown in FIG. 6, in a state where a spool housing 205 of the OCV 204 is accommodated in a mounting bore 210 of the sleeve 208, a bolt hole 204*c* of a bracket 204*b* provided on the OCV 204 is located in front of the bolt screw-in hole 243. Thus, the OCV 204 is fastened to the valve case 207 by fastening a bolt to the bolt screw-in hole 243 via the bolt hole 204*c*.

A block-like contact portion 230 is formed on the lower surface of the flange portion 240. Intermediate oil passages 226, 228 are formed in the contact portion 230. The intermediate oil passages 226, 228 are connected to oil holes 218, 220 formed downward in the sleeve 208 located in the attaching portion 206. An O-ring 239 (only shown in FIG. 8(C)) is arranged on the lower surface of the contact portion 230 around the opening portions of the intermediate oil passages 226, 228 to seal the opening portions when the contact portion 230 abuts against the upper surface of the cam cap 32.

The cylinder head cover 202 has an opening portion 202*a* directly above the cam cap 32 that is located closest to the variable valve timing mechanism 24. The flange portion 240 of the valve case 207 configured as described above is joined to the surrounding area of the opening portion 202*a* of the cylinder head cover 202 by welding in advance. In this manner, the opening portion 202*a* is completely closed by the valve case 207.

The cylinder head cover 202 that is integrated with the valve case 207 through welding is fastened to the cylinder head 34 with a bolt as shown in FIG. 7. When the cylinder head cover 202 is attached to the cylinder head 34, the intermediate oil passages 226, 228 of the contact portion 230 are connected to the cam cap oil passages 36, 38 of the cam cap 32. Since the oil passages 242*a*, 242*b*, 242*c* of the hydraulic oil supplying/draining section 242 are also connected to the oil passages of the cylinder head cover 202, the ECU 40 can selectively retard and advance the rotational phase of the camshaft 42 with respect to the timing sprocket 48 by driving the OCV 204.

The third embodiment has the following advantages.

(a) According to the configuration in which the separately molded valve case 207 is integrated with the cylinder head cover 202 by welding, the cylinder head cover 202 and the sleeve 208 are integrated by the welded valve case 207. As a result, although the sleeve 208 is formed of different material from the valve case 207 and the cylinder head cover 202, the cylinder head cover 202 is secured to the sleeve 208 in a stable manner.

With this configuration also, the advantages (a) to (f) of the first embodiment are provided.

The embodiments may be modified as follows.

Figure 9:
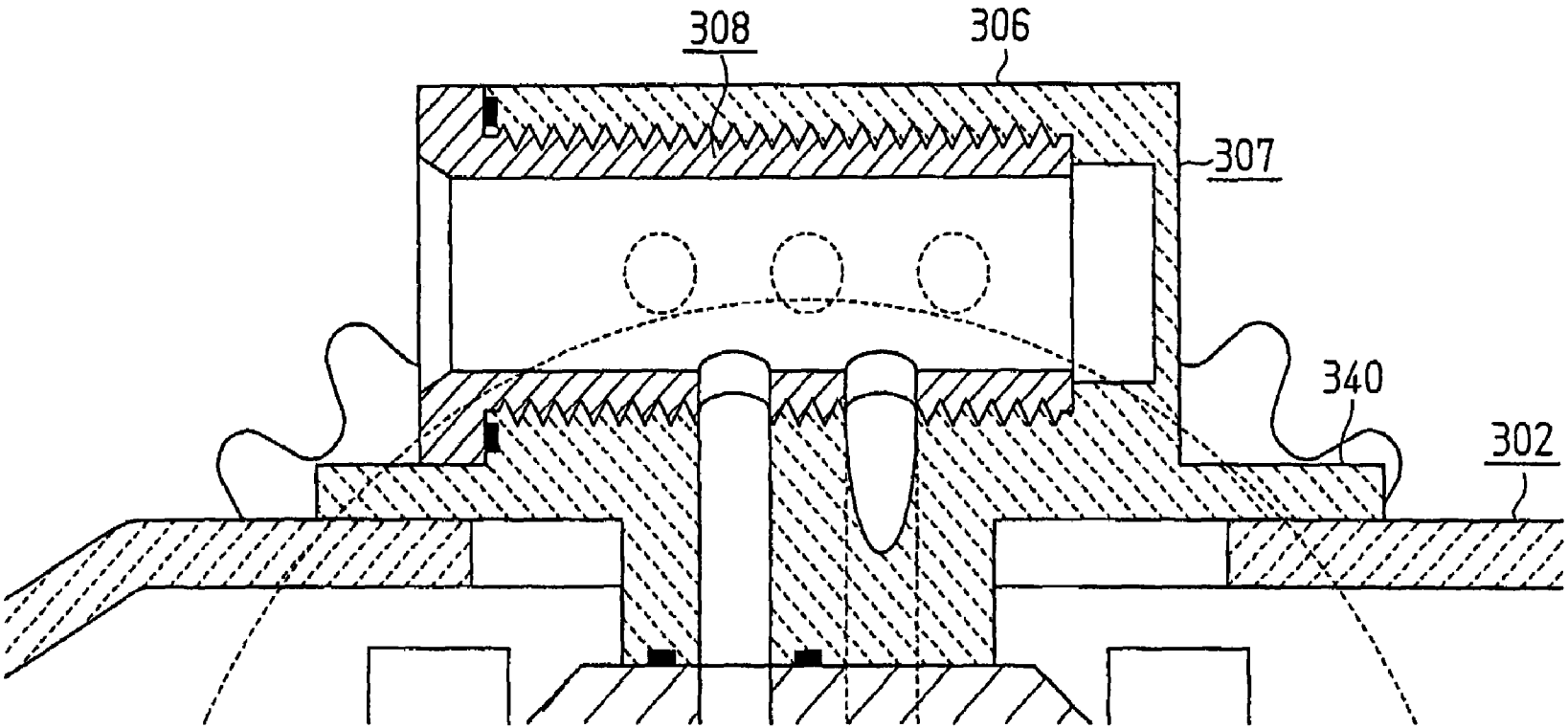
FIG. 9 is a longitudinal cross-sectional view illustrating the vicinity of an attaching portion of a cylinder head cover according to a modified example of the present invention in which a sleeve is screwed to a valve case.

In the third embodiment, a sleeve 308 may be secured to an attaching portion 306 of a valve case 307 using the screwing structure of the second embodiment as shown in FIG. 9. In this case, the flange portion 340 is joined to the cylinder head cover 302 by welding. With this configuration also, the advantage (a) of the second embodiment is provided.

Besides insert molding or screwing, a sleeve may be embedded in an attaching portion in a state where the sleeve is adhered to the attaching portion with an adhesive. In this case, primer may be applied below the adhesive in advance.

Alternately, during insert molding, an adhesive such as epoxy resin may be applied to the outer circumferential surface of the sleeve instead of the primer, or an adhesive may be applied on the primer before insert molding so that the adhesive strongly bonds with the resin.

In a case where the valve case 207, 307 is provided as described in the third embodiment or as shown in FIG. 9, the flange portion 240, 340 is joined to the cylinder head cover 202, 302 by welding, but other joining method may be used. For example, an adhesive may be used.

In the first and second embodiments, the orientation of the attached OCV is horizontal as shown in the drawings. However, the orientation of the OCV may be that the distal end of the OCV, that is, the end opposite to the solenoid is inclined downward. When the distal end of the OCV is inclined downward, the hydraulic oil that slightly leaks from the clearance between the sleeve and the spool housing is more reliably drained into the cylinder head cover.

In a case where the valve case is used as shown in FIGS. 6 to 9, a hole that is connected to the interior of the cylinder head cover may be formed at the innermost end of the interior space of the attaching portion in which the sleeve is arranged. In this case, the hydraulic oil that slightly leaks from the clearance between the sleeve and the spool housing is drained inside the cylinder head cover. Additionally, the leaking hydraulic oil is more reliably drained into the cylinder head cover by tilting the distal end of the OCV downward.

The OCV can be tilted by simply tilting the OCV with respect to the cylinder head cover, but may also be tilted by tilting the cylinder head cover when the cylinder head cover is attached to the cylinder head.

The variable valve timing mechanism 24 may be other variable valve actuation mechanisms such as a variable valve lift mechanism.

The invention claimed is:

1. A resin cylinder head cover that permits an oil control valve to be attached, the oil control valve having ports and controlling supply and drainage of hydraulic pressure to and from a variable valve actuation mechanism of an internal combustion engine, the cylinder head cover comprising:

an attaching portion formed of resin, the attaching portion is a portion of the cylinder head cover to which the oil control valve is to be attached; and a sleeve embedded in the attaching portion, the sleeve having an interior space that permits the oil control valve to be accommodated therein and oil holes, wherein each oil hole is selectively connected to one of the ports of the oil control valve accommodated in the interior space of the sleeve, and the sleeve being formed of material having higher rigidity than the resin forming the attaching portion.

2. The cylinder head cover according to claim 1, wherein the cylinder head cover includes a cover main body, which is a portion of the cylinder head cover other than the attaching portion, and the attaching portion is formed separately from the cover main body and is attached to the cover main body.

3. The cylinder head cover according to claim 1, wherein the sleeve is made of metal.

4. The cylinder head cover according to claim 1, wherein the cylinder head cover further includes a contact portion integrally formed with the attaching portion, wherein the contact portion abuts against a cam cap of the cylinder head, wherein oil passages for supplying and draining hydraulic pressure to and from the variable valve actuation mechanism are formed in the cam cap, intermediate oil passages, each of which connects one of the oil holes of the sleeve to a corresponding one of the oil passages of the cam cap, are formed in the contact portion, and the oil control valve controls supply and drainage of hydraulic pressure to and from the variable valve actuation mechanism through the intermediate oil passages of the contact portion.

5. The cylinder head cover according to claim 4, wherein the cam cap is one of a plurality of cam caps that is located closest to the variable valve actuation mechanism, and the sleeve is embedded in a portion of the cylinder head cover located substantially directly above the one of the cam caps.

6. The cylinder head cover according to claim 1, wherein the sleeve has substantially the same coefficient of thermal expansion as a main body of the oil control valve.

7. The cylinder head cover according to claim 1, wherein the sleeve is embedded in the attaching portion through insert molding of the sleeve to the attaching portion.

8. The cylinder head cover according to claim 1, wherein the sleeve is embedded in the attaching portion in a state where the sleeve is adhered to the attaching portion with adhesive.

9. The cylinder head cover according to claim 1, wherein the sleeve and the attaching portion each have a thread, and the sleeve is embedded in the attaching portion in a state where the sleeve is screwed to the attaching portion using the threads.

* * * * *